US008218401B2

(12) United States Patent
Wilson et al.

(10) Patent No.: US 8,218,401 B2
(45) Date of Patent: Jul. 10, 2012

(54) REMINDER DEVICE

(75) Inventors: David A. Wilson, Coventry (GB); Gurjit S. Dhillon, Coventry (GB); Craig J. Tonge, Coventry (GB)

(73) Assignee: User Limited, Coventry (GB)

( * ) Notice: Subject to any disclaimer, the term of this patent is extended or adjusted under 35 U.S.C. 154(b) by 389 days.

(21) Appl. No.: 12/302,181

(22) PCT Filed: May 25, 2007

(86) PCT No.: PCT/GB2007/001986

§ 371 (c)(1),
(2), (4) Date: Jan. 14, 2009

(87) PCT Pub. No.: WO2007/138308

PCT Pub. Date: Dec. 6, 2007

(65) Prior Publication Data

US 2009/0201773 A1 Aug. 13, 2009

(30) Foreign Application Priority Data

May 26, 2006 (GB) ..... 0610481.4
Jul. 20, 2006 (GB) ..... 0614427.3

(51) Int. Cl.
*G04F 10/00* (2006.01)

(52) U.S. Cl. ..... 368/108; 368/89

(58) Field of Classification Search ..... 368/108–109, 368/89, 107
See application file for complete search history.

(56) References Cited

U.S. PATENT DOCUMENTS

| | | | | |
|---|---|---|---|---|
| 4,148,272 | A * | 4/1979 | Wetzold | 116/219 |
| 4,629,330 | A * | 12/1986 | Nichols | 368/89 |
| 4,849,948 | A * | 7/1989 | Davis et al. | 368/10 |
| 5,012,229 | A * | 4/1991 | Lennon et al. | 345/1.1 |
| 5,555,223 | A * | 9/1996 | Barainsky | 368/10 |
| 6,337,836 | B1 * | 1/2002 | Eidelson | 368/10 |
| 6,667,936 | B1 * | 12/2003 | Ditzig | 368/10 |
| 6,812,825 | B1 * | 11/2004 | Volk | 340/309.16 |
| 7,079,019 | B1 * | 7/2006 | Ruggiero | 340/457.4 |
| 7,177,235 | B2 * | 2/2007 | Rund | 368/261 |
| 7,362,663 | B2 * | 4/2008 | Kagan | 368/327 |
| 2001/0036129 | A1 | 11/2001 | Carr | |
| 2004/0008585 | A1 * | 1/2004 | Augspurger et al. | 368/101 |
| 2007/0058490 | A1 * | 3/2007 | Stange et al. | 368/10 |
| 2007/0091726 | A1 * | 4/2007 | Stauffer et al. | 368/10 |
| 2009/0052283 | A1 * | 2/2009 | Puzia | 368/10 |
| 2009/0199857 | A1 * | 8/2009 | Peake et al. | 128/206.28 |
| 2011/0090765 | A1 * | 4/2011 | Brote | 368/10 |

FOREIGN PATENT DOCUMENTS

| | | |
|---|---|---|
| FR | 2695741 | 3/1994 |
| FR | 2775087 | 8/1999 |
| FR | 2788610 | 7/2000 |

* cited by examiner

*Primary Examiner* — Sean Kayes
(74) *Attorney, Agent, or Firm* — Saliwanchik, Lloyd & Eisenschenk

(57) ABSTRACT

A single use reminder device (100) has a tamperproof housing which contains a counter circuit and a power supply. The device includes a status indicator (106) for indicating when a date or time period has elapsed. The device also includes a button (104) can be depressed so as to activate the status indicator (106). A traffic light LED system is operated, whereby a red signal is shown by the status indicator (106) if the date or time has elapsed, and whereby an amber signal is shown if the elapse date or time is imminent. A similar device comprises a laminated card structure having a portion, which can be pressed to provide status information via an LCD.

13 Claims, 3 Drawing Sheets

REMINDER DEVICE

CROSS-REFERENCE TO RELATED APPLICATION

This application is the U.S. national stage application of International Patent Application No. PCT/GB2007/001986, filed May 25, 2007, the disclosure of which is hereby incorporated by reference in its entirety.

BACKGROUND

This invention relates to a reminder device for use in the field of safety test data, expiry dates or sell-by dates and the like.

Health and safety regulations often require electrical appliances or safety equipment to be tested periodically. It is known to use stickers or labels on appliances to show the last and/or next test date. However, these can become worn, displaced or otherwise damaged during use of the appliance, whereby the date information may be lost or rendered illegible. Bar code systems have also been used for collating test date information at a central location. However, such systems can be impractical if the appliance is portable and re-location of the appliance for checking cannot be assured.

SUMMARY

It is an object of the invention to provide an alternative solution to the monitoring of safety test dates or the like which addresses one or more of the above issues.

According to one aspect of the invention, there is provided a reminder device configured to monitor the passing of a predetermined date or time period, the device including a status indicator configured to selectively indicate whether said date or time period has elapsed, wherein the status indicator is activated to provide status information upon external activation of the device by a user.

The device preferably incorporates a contact portion, for example a pad or button, which can be pressed by a user, to actuate the status indicator. Preferably, the status indicator incorporates an audio and/or visual alert.

In a preferred embodiment, a series of status indicators are arranged to be illuminated when the contact portion is pressed by a user, dependent upon the proximity to the predetermined date or time period. The device may incorporate a circuit, whereby a red signal is provided if a pre-set test date or time period has elapsed. The circuit may provide an alternative colour signal, such as an amber signal, if the pre-set test date is imminent. In a preferred embodiment, the status indicator is configured to provide its alert function only when the device is agitated, e.g. shaken or said contact portion is pressed.

In one embodiment, the device is incorporated into a laminated structure, wherein a circuit is provided on a substrate, such as a credit card type material or other plastic or board member, and overlaid with a cover material, whereby an alert is provided when a particular portion of the card is pressed and said date or time period has elapsed and/or is due to elapse in the immediate short-term. Alternatively or in addition to the contact portion, the laminated device can be configured to provide an appropriate alert if the device is shaken or otherwise agitated. The status indicator preferably comprises an LCD.

The most preferred embodiments of the device comprise a pre-set, single use unit. These preferred embodiments are intended to operate for only a single time period and cannot be re-set, so as to be disposed of after use. These devices are preferably tamperproof, wherein access to the internal components, for example to reset the timer, is not possible without breaking into the device.

In a preferred embodiment, the device comprises a plastics base having or defining a recess or chamber for the internal components. The device or recess preferably has a peripheral lip, flange or other surface onto which a plastics cover can be heat sealed, so as to permanently encase the internal components in the recess. At least a portion of the cover is preferably transparent, e.g. in the region of the status indicator. The contact portion is preferably visible through the cover. The device may be configured so that the contact portion can be actuated by pressing the overlaying portion of cover. Alternatively, the cover may have one or more apertures, e.g. over the contact portion. The device may comprise a heat sealed plastics moulding, wherein only the contact portion and/or status indicator is exposed.

The device preferably includes a starter device, for example a pull-out tag of known construction, which will effectively initiate a countdown for a single predetermined time period, for example 12 months, 3 months or 6 weeks, once removed.

For 12 month devices, the unit will remain in standby mode once the countdown has started. If the contact portion is pressed before the end of the countdown, a green light will flash to indicate how many full calendar months are left in the countdown. The unit will flash an amber light every 30 minutes and/or also if the contact portion is pressed when there is less than a single calendar month remaining, the amber light being replaced by a red light every 60 seconds when the unit has reached the end of its countdown. Flashing will continue until the internal power source is exhausted. The number of weeks since the countdown ended can be determined by pressing the contact portion, whereupon a flashing red light will indicate the number of weeks.

For 3 month devices, the unit will remain in standby mode once the countdown has started. If the contact portion is pressed before the end of the countdown, a green light will flash to indicate how many full calendar months are left in the countdown. The unit will flash an amber light every 30 minutes when there is less than 10 weeks or 70 days remaining, replaced by a red light every 60 seconds after the 12 weeks of the countdown period. Again, flashing will continue until the internal power source is exhausted, and the number of weeks since the countdown ended can be determined by pressing the contact portion, whereupon a flashing red light will indicate the number of weeks.

For 6 week devices, the unit will remain in standby mode once the countdown has started. If the contact portion is pressed before the end of the countdown, a green light will flash to indicate how many full weeks are left in the countdown. The unit will flash an amber light every 30 minutes when there is less than 5 weeks or 35 days remaining, replaced by a red light every 30 seconds after the 6 weeks of the countdown period. Again, flashing will continue until the internal power source is exhausted, and the number of weeks since the countdown ended can be determined by pressing the contact portion, whereupon a flashing red light will indicate the number of weeks.

In alternative embodiments, the contact portion can be omitted. As such, according to a simplified aspect of the invention, there is provided a reminder device configured to monitor the passing of a predetermined date or time period, the device including a status indicator for providing an alert automatically if said predetermined date or time period has elapsed. The device may include a circuit whereby the status indicator provides a status indication, e.g. a warning signal indicative of the time period being close to its date or time of elapse, if the device is externally activated, e.g. by shaking etc.

There is also provided an electrical plug or connector incorporating a device according to any of the above aspects of the invention.

There is also provided safety extinguisher incorporating a device according to any of the above aspects of the invention.

According to another aspect of the invention, there is provided a safety test data device comprising a unitary body incorporating a control circuit for monitoring the passing of a predetermined date or time period, a status indicator configured to selectively indicate whether said date or time period has elapsed, and a contact portion for activating the status indicator, wherein the status indicator provides status information when said contact portion is pressed by a user.

The invention is advantageous in that it provides a convenient solution to problems associated with co-ordinating safety test programmes for electrical appliances. The device can be fitted to or adjacent an electrical appliance, and users of the appliance are encouraged to interact with the device, e.g. via the contact portion, to determine whether the appliance is due for testing.

The test history of vehicles and/or parts thereof can also be monitored using the invention. In particular, the invention has advantageous application for the testing of HGV cabs and trailers and other vehicles which need to undergo regular checking, wherein the driver of the vehicle can use a cab-mounted device to determine whether the cab or trailer has exceeded a safety test deadline.

The invention is of particular use for the health and safety testing of electrical appliances, but also fire extinguishers and the like, as well as office or laboratory equipment. It can also be used to remind users of calibration deadlines for testing hospital equipment, and also for indicating sell-by/expiry/destruction dates for consumables, for example. The invention can be readily incorporated into refrigeration units.

BRIEF DESCRIPTION OF THE DRAWINGS

Other aspects and features of the invention will be readily apparent from the claims and the following description of preferred embodiments of the invention, which is made, by way of example only, with reference to the accompanying drawings, in which:

DETAILED DESCRIPTION

Figure 1:
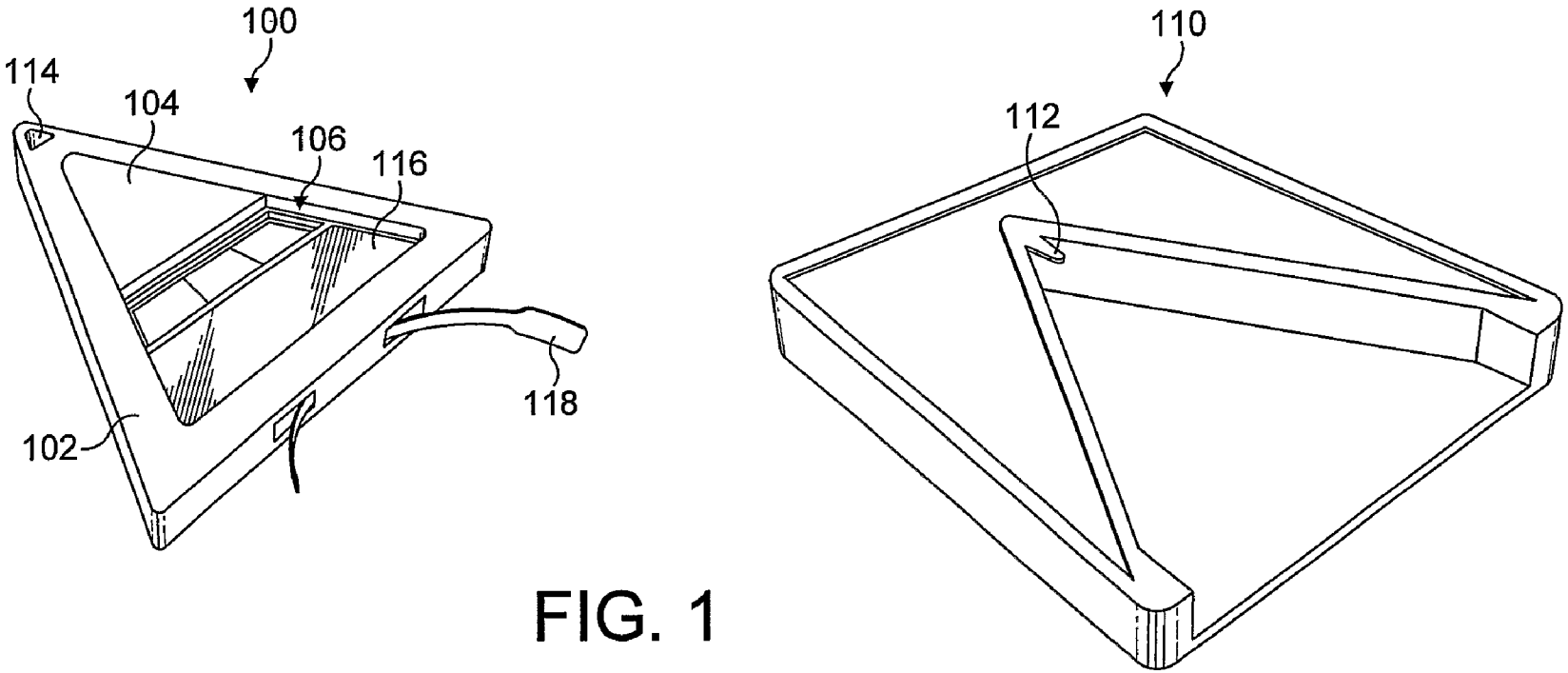
FIG. 1 is a schematic perspective view of a safety reminder device and its holder.

Referring firstly to FIG. 1, a reminder device is indicated generally at 100 consisting of a moulded plastics body 102 in which is mounted a contact button 104 and a status indicator 106.

A control circuit (not shown), preferably including a processor, is mounted in the body 102, e.g. beneath the button 104 and status indicator 106. The control circuit preferably includes a timer which can be activated to begin a count down for a predetermined or pre-programmed time period. Alternatively, a electronic calendar can be incorporated for monitoring a predetermined time period, for example 6 weeks, 3 months, 6 months, or 12 months. In either case, the control circuit is configured to provide an alert via the status indicator 106 when a predetermined date or time period has elapsed and/or is close to elapsing.

In the illustrated embodiment, the status indicator 106 incorporates three LEDs arranged to indicate a green signal if the stored date or time period has yet to elapse, a yellow (or amber) signal if the stored date or time period has almost elapsed (for example within two weeks of the elapsed date), and a red signal if the date or time period has elapsed.

A power source in the form of a lithium battery (not shown) is mounted in the device 100 for powering the control circuit.

To conserve power, the control circuit is configured to illuminate the LEDs only when the contact button 104 is pressed by a user. Alternatively or additionally, it may be configured to intermittently illuminate the amber LED as the elapse date or the end of the predetermined time period approaches and/or to permanently or intermittently illuminate the red LED when the particular date has elapsed, for example. The frequency of red illumination is preferably higher than the frequency of amber illumination.

The device 100 is supplied in a pre-set state, so as to be operable for one or more fixed periods, e.g. for indicating a red light on the status indicator after a 6 month period. The device 100 includes a pull-out tab 118, for use in activating the countdown function of the control circuit.

The device 100 is formed as a robust and sealed unit, whereby access to the internal components of the device 100 is substantially inhibited. It is preferred if the body 102 is tamperproof, e.g. formed in such a manner as to provide a unitary, single piece housing around the internal components, to prevent access to the internal components without smashing or otherwise breaking into the device. Hence, such units are typically factory set, whereby the timer circuit is preferably non-resettable.

As can be seen in FIG. 1, the body 102 defines an upper periphery around the button 104 and status indicator 106 in FIG. 1. The periphery delimits a recess into which the internal components are fitted. In a preferred embodiment, a transparent cover (not shown) is heat sealed or otherwise permanently affixed onto the body 102, whereby to encase the button 104 and status indicator 106 in the device. The cover may be a sheet or film of preferably plastics material. The device 100 is preferably arranged so that the contact portion can be actuated by pressing the overlaying portion of cover. Alternatively, the cover may have an aperture over the contact button 104. However, access to the internal components, for example to reset the timer, is not possible without breaking the cover or base 102. The device 100 is intended to be disposed of after use and may be broken down and recycled.

The device 100 can be removably received in a holder 110 by a friction fit, for example using inter-engaging ribs and grooves between the device 100 and its holder 110, or a clip or snap-fitting engagement. In the illustrated embodiment, the holder 110 includes a nib 112 adapted to snap-fittingly engage in a detent 114 on the body 102. The holder 100 can then be secured to a desired location, for example on an appliance so that the device is portable with the appliance.

The device 100 can be fitted to or adjacent an electrical appliance, and users of the appliance are encouraged to press the contact button 104 on the device 100 to determine whether the appliance is due for testing.

If the button 104 is pressed and the status indicator 106 remains inactive, the user must assume that the power source for the device 100 is inactive. A telephone number or other contact address can be provided on the unit, for example on data bar 116 on the front of the device 100, for reporting that the device is faulty. An additional panel for signature by a test engineer and or space for a conventional barcode may also be included on the device or holder.

Figure 2:
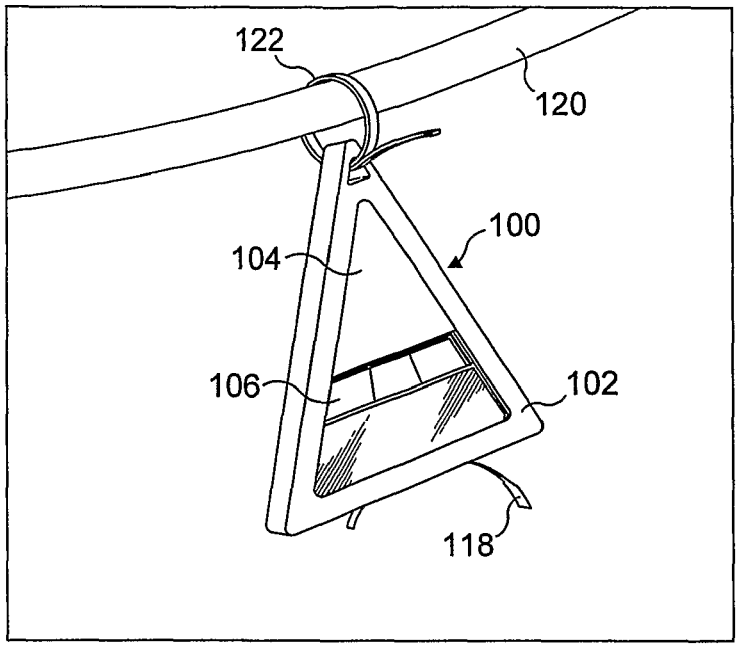
FIG. 2 shows the device of FIG. 1 attached to an electrical cable.
Figure 3:
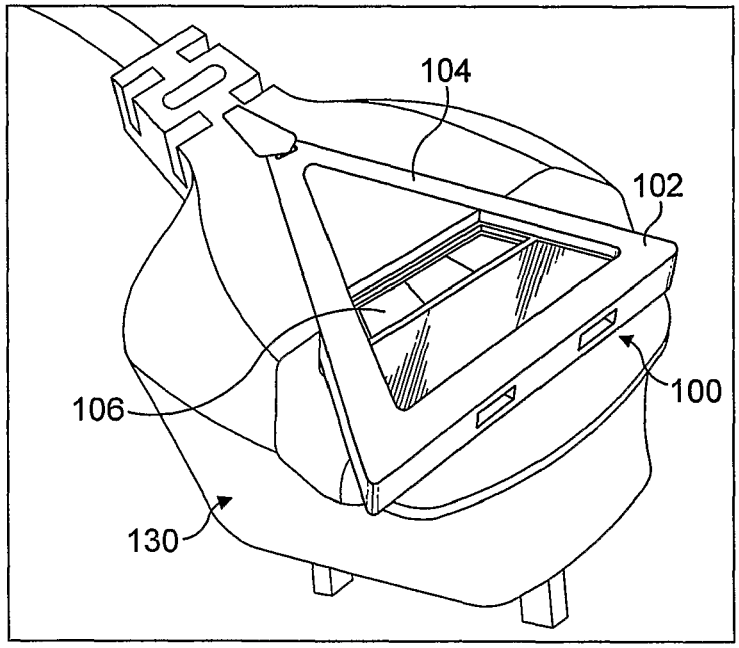
FIG. 3 shows an electrical plug incorporating the device of FIG. 1.
Figure 4:
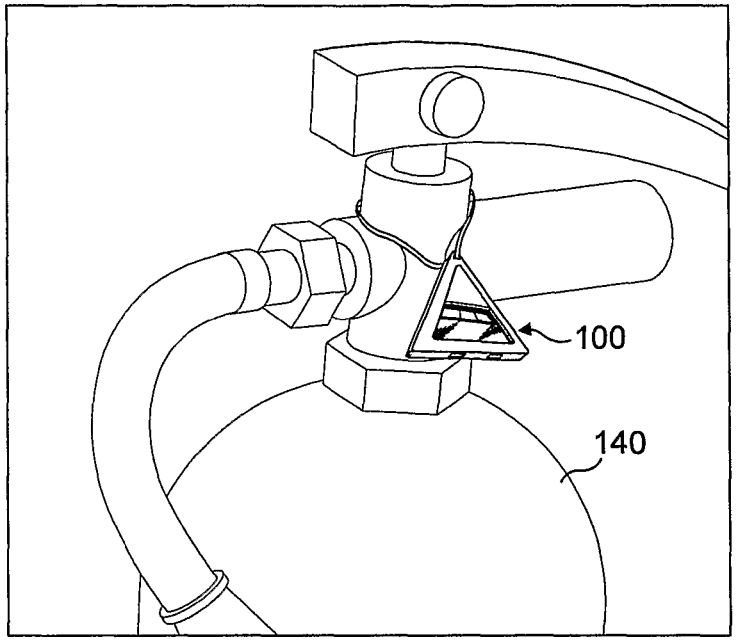
FIG. 4 shows the device of FIG. 1 attached to a fire extinguisher.
Figure 5:
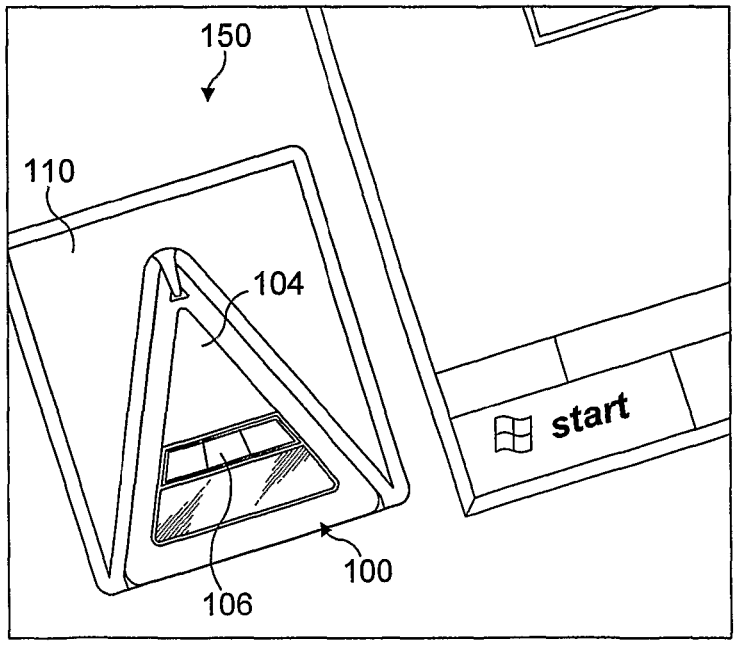
FIG. 5 shows the device and holder of FIG. 1 mounted on a computer monitor.

Several suitable applications for the device are indicated in FIGS. 2 to 5. In FIG. 2, the device 100 is shown secured to an electrical cable 120 via a cable tie 122, so as to travel with the cable 120 for permanent association with the cable and any appliance or plug connected at the ends of the cable. In FIG. 3, the device 100 forms an integral part of an electrical plug 130. The device can be removably received in the plug head if desired. In FIG. 4, the device is secured to a safety extinguisher 140 using a tether 142, although it may also be formed as an integral part of the extinguisher housing or handle. In FIG. 5, the combination of device 100 and holder 110 is shown fitted to a computer monitor 150.

Although shown in triangular form in the Figures, the device 100 may take any suitable shape and construction. However, the device 100 and/or its display will typically be no larger than the body of a conventional wristwatch, credit card or pager.

The most preferred embodiments are intended to be tamperproof and non-resettable, other embodiments may utilise a body which can be opened only using a unique and dedicated key or other such mechanism, so as to enable only authorised persons to access the control circuit, for example for re-setting or maintenance.

A solar cell may be incorporated in the device 100 to supplement or replace the batteries. An LCD display may also be incorporated for displaying pre-programmed messages or other data to users, for example when the contact button 104 is pressed or if the test deadline has elapsed. Such messages may include a name or number for contact to arrange re-testing of the associated appliance, for example.

The invention has thus far been described as having a status indicator 106 which is activated when the contact button 104 is pressed by a user. The button may take the form of an object which can be physically depressed relative to the housing. However, it may take the form of a simple contact pad, tab or other such contact portion, whereby in each case, the control circuit is initiated to provide an appropriate alert via the status indicator, if necessary, if a user presses the contact portion.

A plurality of buttons may be included which must be pressed in a predetermined manner, e.g. together or in sequence, in order to cause activation of the status indicator, thereby to reduce power consumption and to deter intermittent intervention from casual or unauthorised users.

In alternative embodiments, the contact portion can be omitted. For example, the status indicator 106 can be configured to provide its alert function only when the device is agitated, e.g. shaken. In a simplified embodiment, the device can be configured without a contact portion or other external activation means for the status indicator, wherein an alert, for example a red light, is automatically provided only after the pre-determined time period or date has elapsed.

In those embodiments where the device is removable from a holder, the power source can be integral with the holder, and may take the form of a solar panel and/or a piezoelectric power source which generates power upon agitation of the holder. These power sources may alternatively be incorporated into the body of the device.

In a further embodiment, the device or its holder incorporates a transmitter for transmitting status information to a remote location. A transceiver can be incorporated, whereby the device can be remotely activated and/or reset. The transceiver can also be used for indicating the position of the device, for example if the device is secured to or integral with a portable or movable object.

The invention claimed is:

1. A single use reminder device comprising:

a counter circuit, an activator for selectively activating the counter circuit, and a status indicator for indicating when a predetermined time date or time period has elapsed and/or is due to elapse according to the counter circuit, wherein the status indicator is configured for external activation by a user after the counter circuit has been activated, for providing an indication, on demand, as to whether said predetermined time date or time period has elapsed and/or is due to elapse; and wherein the device includes a contact portion to be pressed by a user for said external activation of the status indicator and to actuate the status indicator for providing said indication, on demand, as to whether said predetermined time date or time period has elapsed and/or is due to elapse; and wherein the single use reminder device is further configured such that the activator may only be used once to selectively activate the counter circuit.

2. A reminder device according to claim 1, wherein the device comprises a tamperproof housing whereby the counter circuit is non-resettable.

3. A reminder device according to claim 1, wherein the activator comprises a pull-out tag for initiating the counter circuit.

4. A reminder device according claim 1, wherein the contact portion is a single button or pad.

5. A reminder device according to claim 1, further comprising a base for the internal components and a cover which is sealed over the base.

6. A reminder device according to claim 5, wherein the base includes a peripheral region onto which the cover is secured.

7. A reminder device according to claim 5, wherein at least a portion of the cover is transparent.

8. A reminder device according to claim 5, wherein the status indicator is arranged to be actuated when a respective portion of the cover is pressed.

9. A reminder device according to claim 5, wherein the cover includes an aperture through which a contact portion can be pressed for external activation of the status indicator.

10. A reminder device according to claim 1, comprising a laminated structure, wherein a circuit is provided on a planar base and overlaid with a cover material, whereby a visual alert is provided when a particular portion of the laminated structure is pressed, if said predetermined time period or date has elapsed.

11. A reminder device according to claim 1, wherein the status indicator provides a visual indicator if said time period or date has elapsed upon external activation by a user after the counter circuit has been activated.

12. A reminder device according to claim 1, wherein the status indicator is configured to produce three separate status indications; that the date or time period has not elapsed, that the date or time period is shortly due to elapse, and that the date or time period has already elapsed.

13. A reminder device according to claim 12, including three different colored visual indicators.

* * * * *